US012439999B2

(12) United States Patent
Neumann, IV et al.

(10) Patent No.: US 12,439,999 B2
(45) Date of Patent: Oct. 14, 2025

(54) SOLE STRUCTURES WITH MIDFOOT GAPS AND FOREFOOT BLADDERS IN REINFORCING CAGES FOR ARTICLES OF FOOTWEAR

(71) Applicant: NIKE, Inc., Beaverton, OR (US)

(72) Inventors: Kort W. Neumann, IV, Portland, OR (US); Bryan K. Youngs, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/641,976

(22) Filed: Apr. 22, 2024

(65) Prior Publication Data

US 2024/0268514 A1 Aug. 15, 2024

Related U.S. Application Data

(63) Continuation of application No. 17/835,386, filed on Jun. 8, 2022, now Pat. No. 11,986,052.

(60) Provisional application No. 63/208,961, filed on Jun. 9, 2021.

(51) Int. Cl.

| | |
|---|---|
| ***A43B 13/20*** | (2006.01) |
| ***A43B 13/04*** | (2006.01) |
| ***A43B 13/12*** | (2006.01) |
| ***A43B 13/18*** | (2006.01) |

(52) U.S. Cl.
CPC ..... *A43B 13/20* (2013.01); *A43B 13/04* (2013.01); *A43B 13/125* (2013.01); *A43B 13/188* (2013.01)

(58) Field of Classification Search
CPC ..... A43B 13/20; A43B 13/04; A43B 13/125; A43B 13/188; A43B 13/181; A43B 13/187
USPC ..... 36/107, 108
See application file for complete search history.

(56) References Cited

U.S. PATENT DOCUMENTS

| | | | | |
|---|---|---|---|---|
| 10,849,387 | B2 * | 12/2020 | Bruce | A43B 7/1445 |
| 2004/0049946 | A1 * | 3/2004 | Lucas | A43B 1/0009 36/28 |
| 2011/0302809 | A1 * | 12/2011 | Kim | A43B 13/187 36/103 |
| 2016/0219978 | A1 * | 8/2016 | Elder | F16F 1/10 |

(Continued)

FOREIGN PATENT DOCUMENTS

| | | | |
|---|---|---|---|
| CN | 108348037 | A | 7/2018 |

*Primary Examiner* — Haley A Smith
(74) *Attorney, Agent, or Firm* — Quinn IP Law

(57) ABSTRACT

Presented are sole structures with midfoot gaps and cage-reinforced bladders, methods for making/using such sole structures, and footwear fabricated with such sole structures. A sole structure includes an outsole with a ground-engaging surface, and a midsole with first and second midsole segments. The first midsole segment includes a cushion that attaches to an upper's hindfoot region and to the outsole's upper surface. The second midsole segment, which is spaced from the first midsole segment by a midfoot gap, includes a fluid-filled bladder spaced from another cushion by a forefoot gap. The cushion and bladder attach to the outsole's upper surface and to the upper's forefoot region. A cage, which partially surrounds the second midsole segment, includes a cage plate that attaches to the upper and the fluid-filled bladder. Arcuate cage wings project from opposing medial and lateral sides of the cage plate and insert between the second cushion and outsole.

23 Claims, 5 Drawing Sheets

(56) References Cited

U.S. PATENT DOCUMENTS

2018/0213886 A1* 8/2018 Connell ..... A43B 13/184

* cited by examiner

SOLE STRUCTURES WITH MIDFOOT GAPS AND FOREFOOT BLADDERS IN REINFORCING CAGES FOR ARTICLES OF FOOTWEAR

CLAIM OF PRIORITY AND CROSS-REFERENCE TO RELATED APPLICATIONS

This application is a continuation of U.S. patent application Ser. No. 17/835,386, which was filed on Jun. 8, 2022, is now allowed, and claims the benefit of priority to U.S. Provisional Patent App. No. 63/208,961, which was filed on Jun. 9, 2021, both of which are incorporated herein by reference in their respective entireties and for all purposes.

TECHNICAL FIELD

The present disclosure relates generally to articles of footwear. More specifically, aspects of this disclosure relate to athletic shoes with fluid-filled bladders and split-region sole structures.

BACKGROUND

Articles of footwear, such as shoes, boots, slippers, sandals, and the like, are generally composed of two primary elements: an upper for securing the footwear to a user's foot, and a sole for providing subjacent support to the foot. Uppers may be fabricated from a variety of materials, including textiles, polymers, natural and synthetic leathers, etc., that are stitched or bonded together to form a shell or harness for securely receiving a foot. Many sandals and slippers, for example, have an upper with an open toe and/or open heel construction. Some designs employ an upper that is limited to a series of straps extending over the instep and, optionally, around the user's ankle. Conversely, many boot and shoe designs employ a full upper with a closed toe and heel construction that encases the foot. An ankle opening through a rear quarter portion of the upper provides access to the footwear's interior, facilitating entry and removal of the foot into and from the upper. A lace or strap may be utilized to secure the foot within the upper.

A sole structure is mounted to the underside of the upper, positioned between the user's foot and the ground. In many articles of footwear, including athletic shoes and boots, the sole structure is a layered construction that generally incorporates a comfort-enhancing insole, an impact-mitigating midsole, and a surface-contacting outsole. The insole is typically a thin and compressible member that provides a contact surface for the underside "plantar" region of the user's foot. By comparison, the midsole is mounted underneath the insole, forming a middle layer of the sole structure. In addition to attenuating ground reaction forces, the midsole may help to control foot motion and impart enhanced stability. Secured underneath the midsole is an outsole that forms the ground-contacting portion of the footwear. The outsole is usually fashioned from a durable, wearproof material that includes tread patterns engineered to improve traction.

Many conventional midsoles are single-layer, unitary structures that extend continuously along the fore-aft length and medial-lateral width of the shoe. Midsoles are typically made of an impact-attenuating polymer foam material, such as polyurethane or ethylene vinyl acetate. These materials compress resiliently under an applied load, such as user-generated forces during running, jumping, lateral gait, etc., to provide cushioning to the user's feet and legs. Additional durability and ground-reaction-force attenuation may be provided to the wearer of the footwear through the inclusion of fluid-filled chambers and bladders within the midsole. In general, a fluid-filled bladder is formed from an elastomeric polymer material that is sealed, pressurized, and mounted to or encapsulated within the midsole's polymer foam. To impart shape to or retain an intended shape of a fluid-filled bladder, tensile members of textile or foam may be located within the bladder's internal fluid chamber or reinforcing structures may be bonded to an exterior surface of the bladder.

SUMMARY

Presented herein are footwear sole structures with midfoot flexion gaps and cage-reinforced forefoot bladders, methods for making and methods for using such sole structures, and footwear fabricated with such sole structures. In a non-limiting example, a sole structure for an article of footwear is segmented into a forefoot region and a hindfoot region with a midfoot flexion gap separating the forefoot and hindfoot sole regions. Contrary to some conventional midsole designs that merely incorporate a transverse channel or deep grooves into the midfoot region's polymer foam, the midfoot flexion gap altogether eliminates polymer foam in the gap region to thereby structurally separate forefoot and hindfoot regions of the midsole. The hindfoot region of the midsole may be limited to a polymer foam cushion that is operatively attached to the footwear upper, e.g., mounted directly to an underside surface of the strobel. A forward segment of the midsole's hindfoot cushion may be reinforced by a moderator plate interposed between the cushion and the upper, whereas a rearward segment of the hindfoot cushion adheres directly to the strobel and wraps around the heel counter to form a heel stabilizer wall. A resilient hindfoot segment of the outsole is mounted to an underside surface of the midsole's hindfoot cushion and may wrap around the heel stabilizer wall.

Continuing with the discussion of the above example, the forefoot region of the midsole may include a moderator plate that is operatively attached to the footwear upper, e.g., mounted directly to an underside surface of the strobel, but stops at the metatarsal phalangeal joints to allow for additional toe flexion. Two forefoot cushions are discretely packaged within the midsole, a forward one of which is mounted directly to an underside surface of the upper and a rearward one of which is mounted directly to an underside surface of the moderator plate. Sandwiched between the two forefoot midsole cushions is a fluid-filled bladder that is also mounted directly to an underside surface of the moderator plate. It may be desirable that the fluid-filled bladder lack direct physical contact with any of the midsole cushions, e.g., for unimpinged expansion and contraction. A forefoot outsole may be mounted directly to underside surfaces of the bladder and the forefoot midsole cushions.

A midsole cage structure partially surrounds and helps to secure in place the midsole's fluid-filled bladder. The cage structure may consist essentially of a pair of wing-shaped flaps that project transversely from opposing medial and lateral sides of the moderator plate. These cage flaps extend in a rearward direction and wrap around—without physically touching—the medial and lateral sides of the bladder. Rearward-most segments of the cage flaps insert underneath the rearward forefoot midsole cushion; the flaps are sandwiched between and secured to the rearward forefoot midsole cushion and the forefoot outsole. It may be desirable that the distal ends of the rearward-most segments of the cage flaps not physically contact each other, e.g., to enable additional mediolateral flexion in the forefoot region of the midsole.

Aspects of this disclosure are directed to footwear sole structures with midfoot flexion gaps and cage-reinforced forefoot bladders. In an example, a sole structure is presented for an article of footwear. The sole structure includes an outsole with opposing upper and lower surfaces; the outsole's lower surface defines a ground-engaging surface of the footwear. The sole structure also includes a midsole with discrete midsole segments that are spaced from each other by a midfoot gap absent any structure. A first (hindfoot) midsole segment includes a first (hindfoot) cushion that attaches on a bottom side thereof to the outsole's upper surface and on a top side thereof to the upper's hindfoot region. The second (forefoot) midsole segment includes a second (forefoot) cushion and a fluid-filled bladder that are spaced from each other by a forefoot gap absent any structure. The forefoot cushion and bladder attach on respective bottom sides thereof to the outsole's upper surface and on respective top sides thereof to the upper's forefoot region. A cage, which at least partially surrounds the second midsole segment, includes a cage plate with a plurality of cage wings projecting from opposing sides of the cage plate. The cage plate is interposed between and attaches to the upper and to a top surface of the forefoot bladder. The cage wings insert between the forefoot cushion and the outsole.

Further aspects of the present disclosure are directed to footwear, such as athletic shoes, with a sole structure having a midfoot flexion gap and a cage-reinforced forefoot bladder. For instance, an article of footwear includes an upper that receives and attaches to a user's foot. A multilayered sole structure is attached to a lower portion of the upper and supports thereon the user's foot. This sole structure includes a multipiece outsole with opposing upper and lower surfaces; the outsole's lower surface defines a ground-engaging surface of the footwear. The sole structure also includes a multipiece midsole with a forefoot midsole segment spaced from a hindfoot midsole segment by a midfoot flexion gap (e.g., a full-width aperture). Any of the disclosed footwear may include other standard footwear features, such as laces, straps, toe caps, lace eyelets, etc.

Continuing with the discussion of the foregoing example, the midsole's hindfoot segment includes a hindfoot cushion that is attached on one side thereof to the outsole's upper surface and is attached on an opposite side thereof to the upper's hindfoot region. In contrast, the midsole's forefoot segment includes a rear forefoot cushion, a front forefoot cushion, and a fluid-filled bladder that is interposed between and longitudinally spaced from the forefoot cushions by respective forefoot gaps. Each of the forefoot cushions and the bladder is attached on one side thereof to the outsole's upper surface and on an opposite side thereof to the upper's forefoot region. A cage at least partially surrounds the midsole's forefoot segment. The cage includes a cage plate that is mounted to an underside surface of the upper and to a top surface of the forefoot's fluid-filled bladder. Multiple arcuate cage wings project from opposing (medial and lateral) sides of the cage plate, wrap around, without touching, the fluid-filled bladder, and insert between the rear forefoot cushion and the outsole.

Additional aspects of this disclosure are directed to manufacturing processes, control logic, and computer readable media for fabricating any of the disclosed sole structures and footwear. In an example, a method is presented for manufacturing a sole structure for an article of footwear. This representative method includes, in any order and in any combination with any of the above or below disclosed features and options: forming an outsole with an outsole upper surface and an outsole lower surface opposite the outsole upper surface and defining a ground-engaging surface of the footwear; forming a midsole including: a first midsole segment including a first cushion configured to attach to the hindfoot region of the upper, and a second midsole segment including a second cushion and a fluid-filled bladder each configured to attach to the forefoot region of the upper such that the second midsole segment is spaced from the first midsole segment by a midfoot gap; attaching the first cushion of the first midsole segment to the outsole upper surface; attaching the second cushion and the fluid-filled bladder to the outsole upper surface such that the fluid-filled bladder is spaced from the second cushion by a first forefoot gap; forming a cage configured to at least partially surround the second midsole segment, the cage including a cage plate and multiple cage wings projecting from opposing sides of the cage plate, the cage plate configured to attach to the upper; attaching the cage plate to the fluid-filled bladder; and inserting the cage wings between the second cushion and the outsole.

For any of the disclosed sole structures, methods, and footwear, the cage wings may be arcuate/rounded/bowed and may wrap around, without touching, the medial and lateral sides of the fluid-filled bladder. Additionally, each arcuate cage wing may include a proximal end that is integral with the cage plate and a distal end, opposite the proximal end, that is interposed between the second cushion and the outsole. In this instance, the distal ends of the arcuate wings may be separated from each other via a raised section of the outsole. Moreover, the distal ends of the arcuate wings may be spaced from, without touching, the fluid-filled bladder.

For any of the disclosed sole structures, methods, and footwear, the outsole may be a bipartite construction with multiple discrete outsole segments that do not touch and are spaced from each other by the midfoot gap. In this instance, a first outsole segment includes an upper surface that is mounted to the first midsole segment, and a second outsole segment includes an upper surface that is mounted to the second midsole segment. The first outsole segment may also include a lower surface opposite its upper surface that defines one segment of the footwear's ground-engaging surface. Likewise, the second outsole segment may include a lower surface opposite its upper surface that defines another discrete segment of the footwear's ground-engaging surface.

For any of the disclosed sole structures, methods, and footwear, the second midsole segment may include multiple cushions that are spaced from the fluid-filled bladder by respective forefoot-region gaps. Each such cushion may attach on one side thereof to the upper's forefoot region and attaches on an opposite side thereof to the outsole's upper surface. Optionally, the footwear may include a strobel that defines the bottom surface of the upper; one or more of the midfoot cushions may mount directly to the strobel. As yet a further option, one cushion may be located on a front side of the bladder and another cushion may be located on a rear side of the bladder such that the fluid-filled bladder is interposed between—without touching—the neighboring cushions.

For any of the disclosed soles, methods, and footwear, the sole structure may also include a moderator plate that mounts to the forefoot, midfoot, and hindfoot regions of the upper. In this instance, the fluid-filled bladder and one or more of the midfoot cushions may mount directly to the moderator plate. The cage, including the cage plate and wings, may be integrally formed with the moderator plate as a single-piece structure. The midfoot cushions may be formed, in whole or in part, from a polymeric foam material, the outsole may be formed, in whole or in part, from a synthetic rubber material, and the cage may be formed, in whole or in part, from a thermoplastic elastomer.

For any of the disclosed sole structures, methods, and footwear, the upper may include a heel counter that defines a rearward end of the upper. In this instance, the midsole's hindfoot segment may wrap around and press against the heel counter to define a heel stabilizer. As another option, the sole structure may also include an insole that seats against the upper's strobel. The midsole's hindfoot cushion may include a cushion ledge that projects forward from the hindfoot region into the midfoot region, extending only part way across the midfoot region. In this instance, the midsole's rear forefoot cushion may include a cushion ledge that projects rearward from the forefoot region into the midfoot region, extending only part way across the midfoot region. The forefoot cushion's ledge is located underneath and spaced from the hindfoot cushion's ledge by the midfoot gap such that there is not direct physical contact between the two ledges.

The above summary does not represent every embodiment or every aspect of the present disclosure. Rather, the Summary section merely provides an exemplification of some of the novel concepts and features set forth herein. The above features and advantages, and other features and attendant advantages of this disclosure, will be readily apparent from the following detailed description of illustrated examples and representative modes for carrying out the present disclosure when taken in connection with the accompanying drawings and the appended claims. Moreover, this disclosure expressly includes any and all combinations and subcombinations of the elements and features presented above and below.

Figure 1:
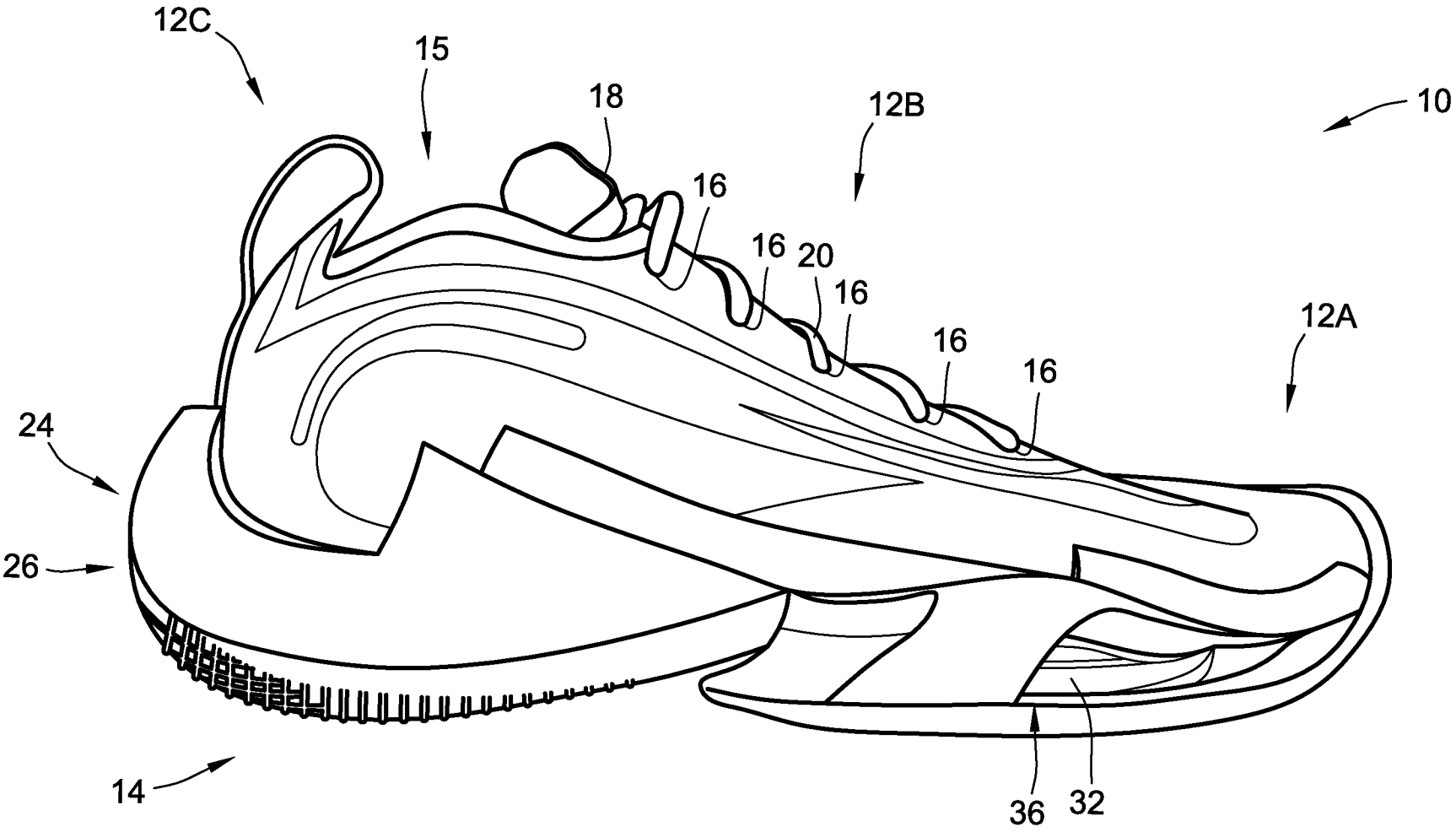
FIG. 1 is an enlarged side-view illustration of a representative article of footwear with a representative sole structure having a midfoot flexion gap and a cage-reinforced forefoot bladder in accordance with aspects of the present disclosure.

The present disclosure is amenable to various modifications and alternative forms, and some representative embodiments have been shown by way of example in the drawings and will be described in detail below. It should be understood, however, that the novel aspects of this disclosure are not limited to the particular forms illustrated in the above-enumerated drawing. Rather, the disclosure is to cover all modifications, equivalents, combinations, subcombinations, permutations, groupings, and alternatives falling within the scope of this disclosure as encompassed by the appended claims.

DETAILED DESCRIPTION

This disclosure is susceptible of embodiment in many different forms. There are shown in the drawings and will herein be described in detail representative embodiments of the disclosure with the understanding that these illustrated examples are provided as an exemplification of the disclosed principles, not limitations of the broad concepts of the disclosure. To that extent, elements and limitations that are described, for example, in the Abstract, Technical Field, Background, Summary, Brief Description of the Drawings, and Detailed Description sections, but not explicitly set forth in the claims, should not be incorporated into the claims, singly or collectively, by implication, inference or otherwise.

For purposes of the present detailed description, unless specifically disclaimed: the singular includes the plural and vice versa; the words "and" and "or" shall be both conjunctive and disjunctive; the words "any" and "all" shall both mean "any and all"; and the words "including," "containing," "comprising," "having," permutations thereof, and like terms, shall each mean "including without limitation." Moreover, words of approximation, such as "about," "almost," "approximately," "substantially," "generally," and the like may be used herein in the sense of "at, near, or nearly at," or "within 0-5% of," or "within acceptable manufacturing tolerances," or any logical combination thereof, for example. Lastly, directional adjectives and adverbs, such as fore, aft, medial, lateral, proximal, distal, vertical, horizontal, front, back, left, right, etc., may be with respect to an article of footwear when worn on a user's foot and operatively oriented with the base of the sole structure seated on a flat surface, for example.

Referring now to the drawings, wherein like reference numbers refer to like features throughout the several views, there is shown in FIG. 1 a representative article of footwear, which is designated generally at 10 and portrayed herein for purposes of discussion as an athletic shoe in the form of a basketball sneaker. The illustrated article of footwear 10—also referred to herein as "footwear" or "shoe" for brevity—is an exemplary application with which novel aspects of this disclosure may be practiced. In the same vein, implementation of the present concepts for a quad-layer polymer sole structure should also be appreciated as a representative implementation of the disclosed concepts. It will therefore be understood that aspects and features of this disclosure may be utilized for other athletic and non-athletic activities, may be integrated into other sole structure configurations, and may be incorporated into any logically relevant type of footwear. As used herein, the terms "shoe" and "footwear", including permutations thereof, may be used interchangeably and synonymously to reference any suitable type of garment worn on a human foot. Lastly, features presented in the drawings are not necessarily to scale and are provided purely for instructional purposes. Thus, the specific and relative dimensions shown in the drawings are not to be construed as limiting.

Figure 2:
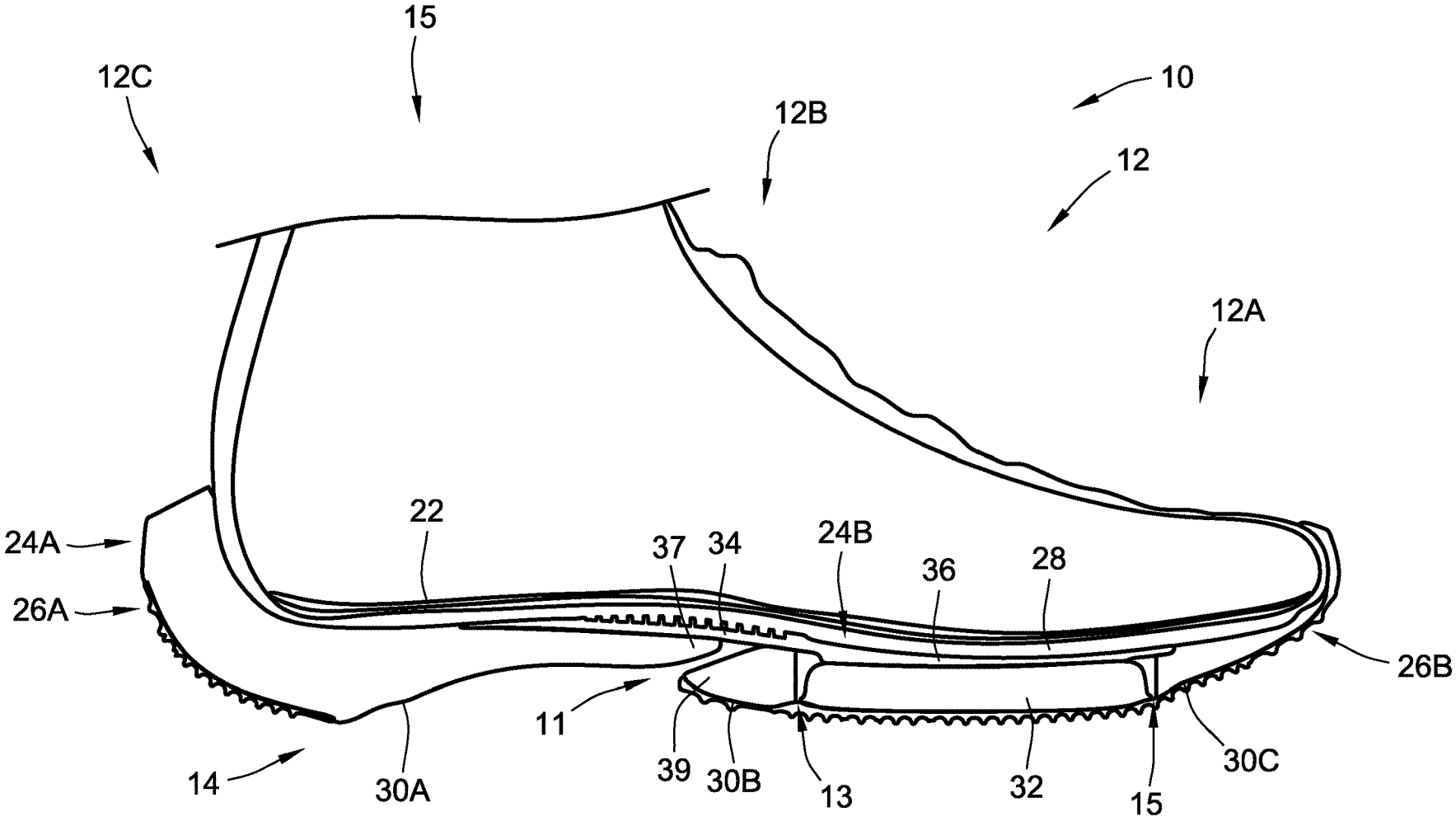
FIG. 2 is a side-view illustration of the representative footwear and sole structure of FIG. 1 takin in cross-section along line 2-2 in FIG. 3.
Figure 3:
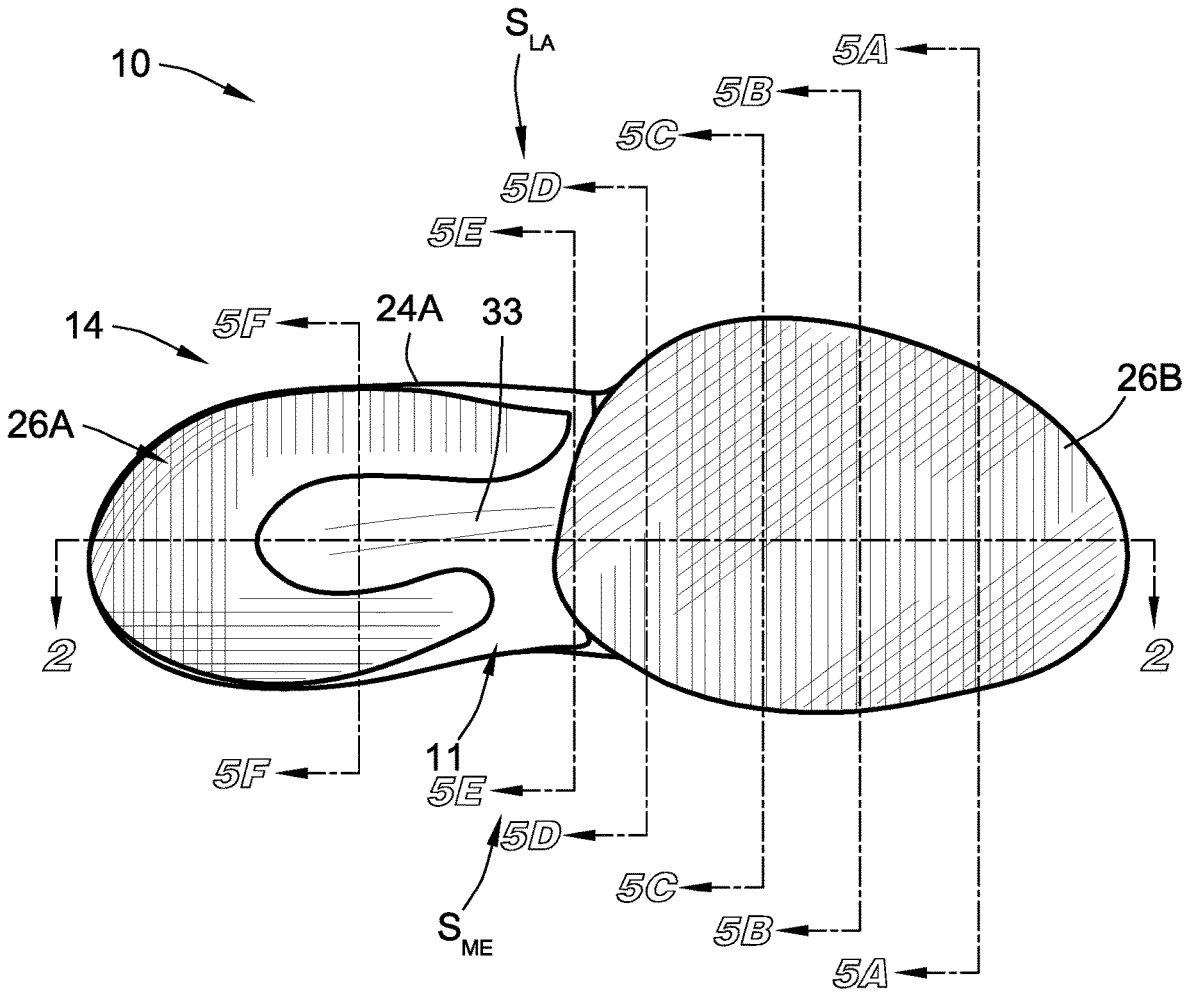
FIG. 3 is a bottom-view illustration of the representative footwear and sole structure of FIG. 1.
Figure 4:
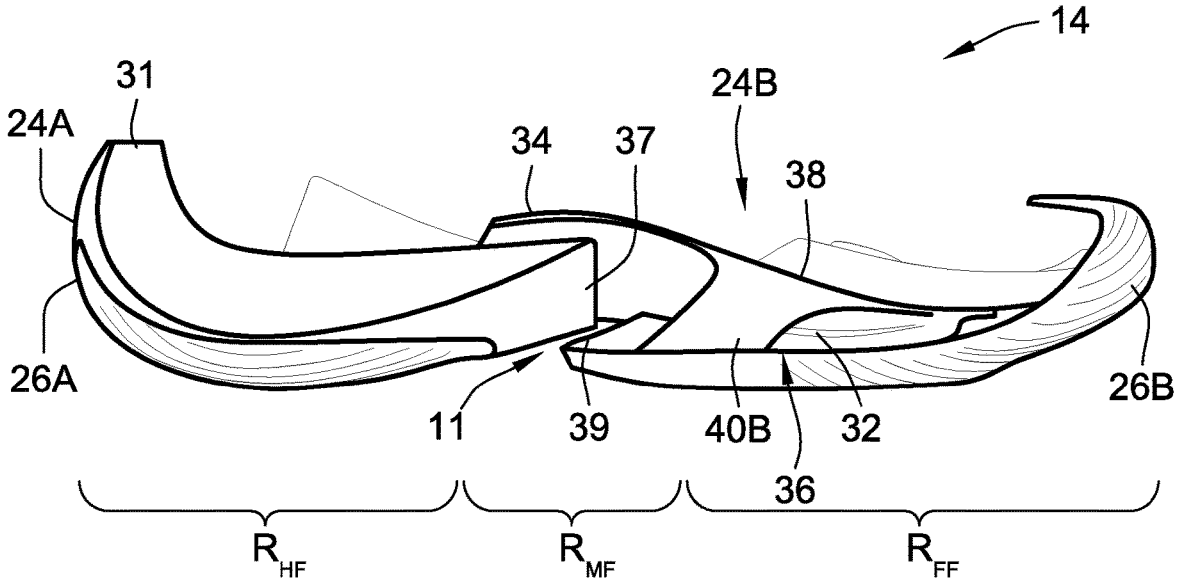
FIG. 4 is an enlarged side-view illustration of the sole structure of FIG. 1 with the upper removed.

The representative article of footwear 10 is generally depicted in FIGS. 1-4 as a bipartite construction that is primarily composed of a foot-receiving upper 12 mounted on top of a subjacent sole structure 14. For ease of reference, footwear 10 may be divided into three anatomical regions: a forefoot (front) region $R_{FF}$, a midfoot (middle) region $R_{MF}$, and a hindfoot (heel or rear) region $R_{HF}$, as shown in FIG. 4. In accordance with recognized anatomical classifications, the forefoot region $R_{FF}$ is located at the front of the footwear 10 and generally corresponds with the phalanges (toes), metatarsals, and any interconnecting joints thereof. Interposed between the forefoot and hindfoot regions $R_{FF}$ and $R_{HF}$ is the midfoot region $R_{MF}$, which generally corresponds with the cuneiform, navicular, and cuboid bones (i.e., the arch area of the foot). Hindfoot region $R_{HF}$, in contrast, is located at the rear of the footwear 10 and generally corresponds with the talus (ankle) and calcaneus (heel) bones.

Footwear 10 of FIGS. 1-4 may also be divided along a vertical plane into a lateral segment $S_{LA}$ and an adjoining medial segment $S_{ME}$, as shown in FIG. 3. The lateral segment $S_{LA}$ may be typified as a distal half of the shoe 10 farthest from the sagittal plane of the human body. Conversely, the medial segment $S_{ME}$ may be typified as a proximal half of the shoe 10 closest to the sagittal plane of the human body. Both lateral and medial segments $S_{LA}$ and $S_{ME}$ of the footwear 10 extend through all three anatomical foot regions $R_{FF}$, $R_{MF}$, $R_{HF}$, and each corresponds to a respective transverse side of the footwear 10. While only a single shoe 10 for a right foot of a user is shown in FIGS. 1 and 2, a mirrored, structurally similar counterpart may be provided for a left foot of a user. Recognizably, the shape, size, material composition, and method of manufacture of the shoe 10 may be varied, singly or collectively, to accommodate practically any conventional or nonconventional footwear application.

With reference again to FIG. 1, the upper 12 is depicted as having a shell-like construction with a closed toe and heel configuration for encasing a human foot. Upper 12 is generally defined by three adjoining sections, namely a toe box section 12A, a vamp section 12B, and a rear quarter/heel counter section 12C. The toe box section 12A is shown as a rounded forward tip of the upper 12 that extends from distal to proximal phalanges to cover and protect the user's toes. By comparison, the vamp section 12B is an arched midsection of the upper 12 that is located aft of the toe box 12A and extends from the metatarsals to the cuboid. As shown, the vamp 12B also defines a throat with a fore-aft-spaced series of lace eyelets 16 and a shoe tongue 18. Positioned aft of the vamp 12B is a rear quarter section 12C that the defines the rear end and rear sides of the upper 12. Rear quarter 12C wraps around the calcaneus bone and originates/terminates at the transverse ends of the tarsal joint. While portrayed in the drawings as a multipiece construction comprising three primary sections, the upper 12 may be fabricated as a single-piece construction or may be composed of any number of segments, including a toe shield, heel cap, ankle cuff, interior liner, etc. For sandal and slipper applications, the upper 12 may take on an open toe configuration, an open heel configuration or, optionally, may be replaced with a single strap or a set of interconnected straps.

The upper 12 portion of the footwear 10 may be fabricated from any one or combination of a variety of materials, such as textiles, engineered foams, polymers, natural and synthetic leathers, etc. Individual segments of the upper 12, once assembled or cut to shape and size, may be stitched, adhesively bonded, fastened, welded, or otherwise joined together to form an interior void for comfortably receiving a foot. The individual material elements of the upper 12 may be selected and located with respect to the footwear 10 in order to impart desired properties of durability, air-permeability, wear-resistance, flexibility, appearance, and comfort, for example. An ankle opening 15 in the rear quarter 12C of the upper 12 provides access to the interior of the shoe 10. A shoelace 20, strap, buckle, or other commercially available mechanism may be utilized to modify the girth of the upper 12 in order to more securely retain the foot within the interior of the shoe 10 as well as to facilitate entry and removal of the foot to/from the upper 12. Shoelace 20 may be threaded through the series of eyelets 16 in the upper 12; the tongue 18 may extend between the lace 20 and the interior void of the upper 12.

Sole structure 14 is rigidly secured to the upper 12 such that the sole structure 14 extends between the upper 12 and a support surface upon which a user is standing. In effect, the sole structure 14 functions as an intermediate support platform that separates and protects the user's foot from the ground. In addition to attenuating ground reaction forces and providing cushioning for the foot, sole structure 14 of FIGS. 1-4 may provide traction, impart stability, and help to limit various foot motions, such as inadvertent foot inversion and eversion. It is envisioned that the sole structure 14 may be attached to the upper 12 via any presently available or hereafter developed joining techniques. For at least some applications, the upper 12 may be coupled directly to the midsole 24, e.g., with the upper 12 adhesively attached to an upper periphery of a midsole top face and secured with a bonding allowance via priming, cementing, and pressing.

In accordance with the illustrated example, the sole structure 14 is fabricated as a sandwich structure with a foot-contacting insole 22, an intermediate midsole 24, and a bottom-most outsole 26. Alternative sole structure configurations may be fabricated with greater or fewer than three layers. Insole 22 is portrayed in FIG. 2 as a sock liner that is located entirely inside the upper 12. The insole 22 may be a "floating" insole, e.g., that movably seats on a top surface of a strobel 28, or may be permanently attached to the upper 12, e.g., bonded or stitched to strobel 28, such that the insole 22 abuts a plantar surface of the foot.

Underneath the insole 22 is a midsole 24 that incorporates one or more materials or embedded elements that enhance the comfort, performance, and/or ground-reaction-force attenuation properties of footwear 10. These elements and materials may include, individually or in any combination, a polymer foam material, such as polyurethane (PU) or ethyl vinyl acetate (EVA), filler materials, moderators, air-filled bladders, plates, lasting elements, or motion control members. Outsole 26 is located underneath the midsole 24, defining some or all of the bottom-most, ground-engaging portion of the footwear 10. The outsole 26 may be formed from a natural or synthetic rubber material that provides a durable and wear-resistant surface for contacting the ground. In addition, the outsole 26 may be contoured and textured to enhance the traction (i.e., friction) properties between footwear 10 and the underlying support surface.

Unlike most conventional footwear sole structures in which the midsole and outsole layers extend continuously from a forward tip of the shoe (e.g., originating at the toe roll) to a rearward tip of the shoe (e.g., terminating at the heel roll), the sole structure 14 is a discontinuous structure with gaps along the fore-aft length of the footwear 10. For instance, the outsole 26 of FIGS. 1-4 is portrayed as a bipartite structure composed of a hindfoot outsole segment 26A (also referred to herein as "first outsole segment") and a distinct forefoot outsole segment 26B (also referred to herein as "second outsole segment") that is physically separated from the hindfoot outsole segment 26A by a midfoot flexion gap 11. As the names imply, the hindfoot outsole segment 26A is located predominantly or entirely within the hindfoot region $R_{HF}$ of the footwear 10, whereas the forefoot outsole segment 26B is located predominantly or entirely within the forefoot region $R_{FF}$ of the footwear 10. Forefoot outsole segment 26B may extend forward and upward to wrap around a forward most edge of the toe box 12A, e.g., to define a toe cap that increases the wear life of the footwear's toe region and improves absorption/attenuation of shock from a toe strike. While shown as a two-piece construction, the outsole 26 may comprise three or more discrete outsole segments that are arranged in any desirable pattern.

An upper surface of the hindfoot outsole segment 26A is mounted or otherwise directly attached to an underside surface or surfaces of a hindfoot midsole segment 24A (also referred to herein as "first midsole segment"). In the same vein, an upper surface of the forefoot outsole segment 26B is mounted or otherwise directly attached to an underside surface or surfaces of a forefoot midsole segment 24B (also referred to herein as "second midsole segment"). As shown, the hindfoot outsole segment 26A lacks a direct physical attachment to/contact with the forefoot midsole segment 24B, and the forefoot outsole segment 26B lacks a direct physical attachment to/contact with the hindfoot midsole segment 24A. Each outsole segment 26A, 26B may be formed from a resilient material, such as natural or synthetic rubber, polyvinyl chloride (PVC), acrylonitrile butadiene styrene (ABS), or polyurethane, that provides the footwear 10 with traction, flexibility, and durability.

Located on an opposite side of the hindfoot outsole segment 26A from the hindfoot midsole segment 24A is a lower outsole surface (FIG. 3) with low-friction traction features that provide a distinct ground-engaging surface in the hindfoot region $R_{HF}$ of the footwear 10. Likewise, a lower surface of the forefoot outsole segment 26B—opposite the upper outsole surface onto which is mounted the forefoot midsole segment 24B—is fabricated with low-friction traction features that provide a forefoot ground-engaging surface that is discrete from the hindfoot ground-engaging surface of the footwear 10. The lower, ground-contacting surfaces may be fabricated with any of an assortment of traction features, such as an engineered tread pattern (FIG. 3), cleats, protuberances, etc., to increase footwear grip and minimize sliding friction.

Similar to the outsole 26, the footwear midsole 24 of FIGS. 1-4 is illustrated as a multi-part construction that is bifurcated into a hindfoot midsole segment 24A and a distinct forefoot midsole segment 24B (also referred to herein as "second midsole segment") that is physically separated from the hindfoot midsole segment 24A by the midfoot gap 11. Put another way, the midfoot gap 11 may be characterized as a void that extends the entire mediolateral width of the footwear 10 and is absent both midsole 24 and outsole 26 structure, e.g., in order to increase the bendability of the footwear around a transverse axis extending through the midfoot region $R_{MF}$. Like the hindfoot outsole segment 26A, hindfoot midsole segment 24A is located predominantly or entirely within the hindfoot region $R_{HF}$ of the footwear 10. Conversely, the forefoot midsole segment 24B is located predominantly or entirely within the forefoot region $R_{FF}$ of the footwear 10. The midsole segments 24A, 24B may extend at least partially onto an outer surface of the upper 12 such that the midsole 24 conceals a junction between the upper's strobel 28 and the sole's midsole 24. Akin to outsole 26, midsole 24 may be segmented into two discrete segments, as shown, or may comprise three or more discrete midsole segments that are arranged in any desirable pattern within the sole structure 14.

The hindfoot midsole segment 24A may be a one-piece design that consists essentially of a hindfoot (first) cushion 30A (FIG. 2) with an arcuate and upwardly projecting rear tail 31 (FIG. 4) and a longitudinally elongated central cavity 33 (FIG. 3). Hindfoot cushion 30A may be directly or indirectly attached along a bottom side thereof to the upper surface of the hindfoot outsole segment 26A and along a top side thereof to the hindfoot region $R^{HF}$ of the upper 12. While not per se required, a rear portion of the hindfoot cushion 30A is portrayed in FIG. 2 mounted, e.g., via bonding, stitching, and/or heat staking, directly to the bottom surface of the footwear strobel 28, whereas a forward portion of the cushion 30A is indirectly attached to the strobel 28 via a moderator plate 34. As yet a further option, the rear tail 31 of midsole segment 24A is shown wrapping around and abutting the upper's heel counter (aftward section of rear quarter 12C) to define a heel stabilizer that increases the wear life of the footwear heel and improves absorption/attenuation of shock from a heel strike. It may be desirable that all of the midsole cushions 30A-30C be formed from a polymeric foam material, such as polyurethane, ethyl vinyl acetate, or other light-weight, force-damping material with desired long-term mechanical properties. An energy-absorbing material, such as PU or EVA foam, allows the midsole 24 to return energy and attenuate ground-reaction forces caused during use of the footwear 10.

Unlike the single-piece construction of hindfoot midsole segment 24A, forefoot midsole segment 24B is a multi-piece assembly with a pair of forefoot cushions 30B and 30C that sandwich therebetween a fluid-filled forefoot bladder 32. As best seen in FIG. 2, the rear-most forefoot cushion 30B (also referred to herein as "second cushion") is located aft of the forefoot bladder 32 and spaced therefrom by a rear forefoot gap 13. The forward-most forefoot cushion 30C (also referred to herein as "third cushion"), on the other hand, is located in front of the forefoot bladder 32 and spaced therefrom by a forward forefoot gap 15. With this arrangement, there is no direct physical contact between the forefoot bladder 32 and the neighboring cushions 30B, 30C, e.g., for standing, jumping, and normal gait motion, which facilitates unimpeded expansion and contraction of the bladder 32. An integral cushion leg 35 (FIGS. 5B and 5C) of the forward forefoot cushion 30C may extend rearward along a lateral side of the forefoot bladder 32. The fluid-filled forefoot bladder 32 may include a hermetically sealed elastomeric sack that is filled with a pressurized gas. It is envisioned that the forefoot midsole segment 24B may include additional cushions and additional bladders arranged in similar or alternative patterns within the intended scope of this disclosure.

Each of the forefoot midsole cushions 30B, 30C and the forefoot bladder 32 is directly or indirectly attached along a respective top side thereof to the upper surface of forefoot outsole segment 26B. Likewise, each cushion 30B, 30C and bladder 32 is directly or indirectly attached along a respective bottom side thereof to the forefoot region $R_{FF}$ of the upper 12. By way of non-limiting example, FIG. 2 shows the top surface of the forward forefoot cushion 30C mounted directly to the strobel 28, e.g., via bonding, stitching, heat staking, etc. A rear-most lip of the forward forefoot cushion 30C may be mounted directly to the moderator plate 34. By comparison, the top surfaces of the rearward forefoot cushion 30B and bladder 32 are mounted directly to the underside surface of the moderator plate 34 and indirectly attached, via the moderator plate 34, to the strobel 28. The bottom surfaces of the forefoot cushions 30B, 30C and bladder 32, on the other hand, are all mounted directly to the upper surface of outsole segment 26B.

With collective reference to FIGS. 2 and 4, the neighboring cushions of the hindfoot and forefoot midsole segments 24A, 24B may be juxtaposed in opposing spaced relation in a manner that provides a structural barrier between the ground and a bottom surface of the moderator plate 34 exposed by the midfoot flexion gap 11. In particular, the hindfoot cushion 30A is formed with an upper cushion ledge 37 that projects forward from the hindfoot region $R_{HF}$ into the midfoot region $R_{MF}$ of the footwear 10. The upper cushion ledge 37 may lay flush against the bottom surface of the moderator plate 34. Contrariwise, the rear forefoot cushion 30B includes a lower cushion ledge 39 that projects rearward from the forefoot region $R_{FF}$ into the midfoot region $R_{MF}$ of the footwear 10. The lower cushion ledge 39 may lay flush against the top surface of the forefoot outsole segment 26B. In accord with the illustrated example, the lower cushion ledge 39 is located underneath and spaced from the upper cushion ledge 37 by the midfoot gap 11 such that the two ledges 37, 39 collectively form a barrier along a vertical plane between the ground and the exposed underside of the moderator plate 38.

Interposed between the footwear upper 12 and select segments of the footwear midsole 24 is a moderator plate 34 that attaches, either directly or indirectly, to predefined sections of the upper's forefoot, midfoot, and hindfoot regions $R_{FF}$, $R_{MF}$, $R_{HF}$. In the illustrated configuration, for example, the moderator plate 34 is attached directly to the upper 12, e.g., via bonding to an underside surface of the strobel 28. With this arrangement, select portions of the moderator plate 34 are visible from the exterior of the footwear 10, as best seen in FIG. 1. Alternatively, the moderator plate 34 may be indirectly attached to the upper 12, for example, by the midsole. For instance, the moderator plate 34 may be embedded within a complementary cavity formed in one or more of the cushions 30A-30C of the midsole; the plate 34 is thereafter attached to the upper 12 by affixing the midsole 24 to the upper 12. This allows the moderator plate 34 to be substantially or completely concealed within the midsole 24 and/or upper 12. As noted above, the hindfoot and forefoot cushions 30A, 30B and the forefoot bladder 32 are mounted directly to an underside surface of the moderator plate 34.

Contrary to conventional plate designs, the moderator plate 34 of FIG. 2 does not extend the entire fore-aft length of the upper 12 and sole structure 14. Rather, the moderator plate 34 may extend in a continuous manner approximately the length of the wearer's plantar fascia, e.g., thus allowing for additional cushioning and shock absorption in the toes and heels. As shown, the plate 34 originates in plane with a posterior end of the talus bone in the hindfoot region $R_{HF}$ of the sole structure 14, extends forward through the midfoot region $R_{MF}$, and terminates in plane with the metatarsal phalangeal joint in an anterior midsection of the forefoot region $R_{FF}$. The moderator plate 34 may be formed with a material having a hardness (e.g., Shore A durometer value) that is higher than a hardness of the material that forms the cushions 30A-30C. By way of example, the moderator plate 34 may be a single-piece structure molded from a thermoplastic polyurethane (TPU), a fiber-reinforced polymer (FRP), a thermoplastic elastomer, or other non-foamed, relatively inflexible polymeric materials. For at least some embodiments, a second moderator plate (not shown) may be interposed between the forefoot outsole segment 26B and the constituent parts of the forefoot midsole segment 24A. As yet a further option, the moderator plate 24 may be partially or wholly removed from the footwear 10 architecture such that one or more or all of the midsole cushions 30A-30C mount directly to the upper 12.

To help enhance the shock-absorbing characteristics of the midsole's forefoot region while protecting the midsole's open-faced, fluid-filled chamber(s), a forefoot cage 36 partially surrounds the forefoot midsole segment 24B. As best seen with collective reference to FIGS. 4, 5B and 5C, the forefoot cage 36 (also referred to herein as "cage") is generally composed of a horizontally oriented, curvilinear cage plate 38 with a pair of arcuate cage wings 40A and 40B that project from opposing medial and lateral sides, respectively, of the cage plate 38. A top surface of the cage plate 38 may directly attach to the footwear upper 12, e.g., via bonding to the underside of strobel 28. A lower surface of the cage plate 38, on the other hand, may directly mount onto a top surface of the forefoot bladder 32. In this instance, the cage plate 38 may extend continuously in a fore-aft direction from an anterior edge to a posterior edge of the bladder's 32 upper contact surface. For at least some embodiments, the cage plate 38 may take on alternative shapes and sizes within the scope of this disclosure. Moreover, the moderator plate 34 and the forefoot cage 36, including the cage plate 38 and cage wings 40A, 40B, may be integrally formed as a single-piece, unitary structure. To that end, the forefoot cage 36 may take on the same material composition as the moderator plate 36 or, alternatively, may be a separate structure formed from a distinct material.

Figure 5A:
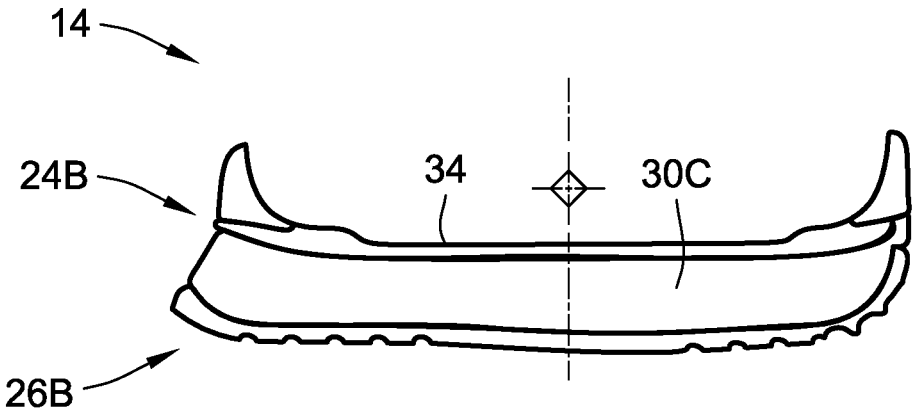
FIGS. 5A-5F are front-view illustrations of the representative sole structure of FIG. 1 taken in cross-section along lines 5A-5A, 5B-5B, 5C-5C, 5D-5D, 5E-5E, and 5F-5F, respectively, of FIG. 3.
Figure 5B:
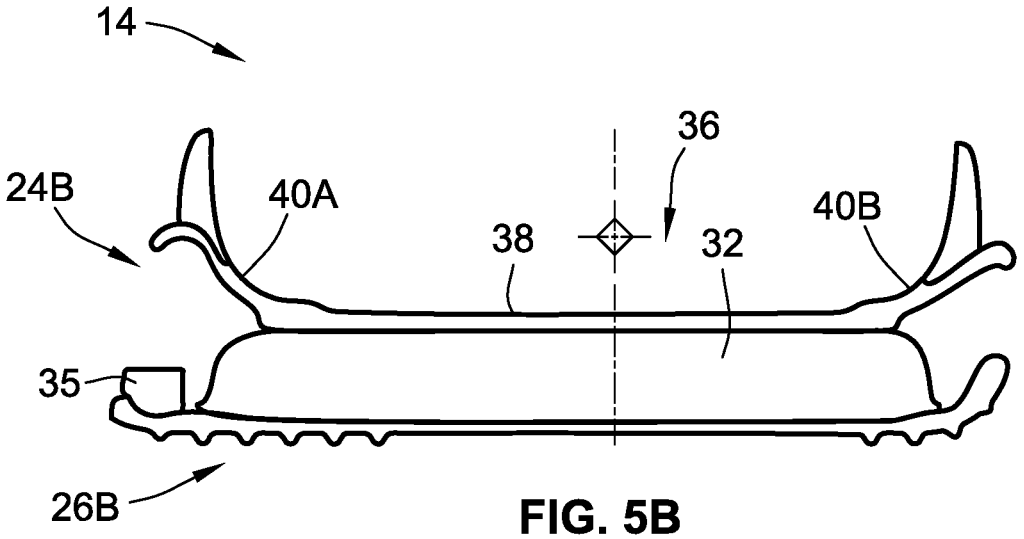
Figure 5C:
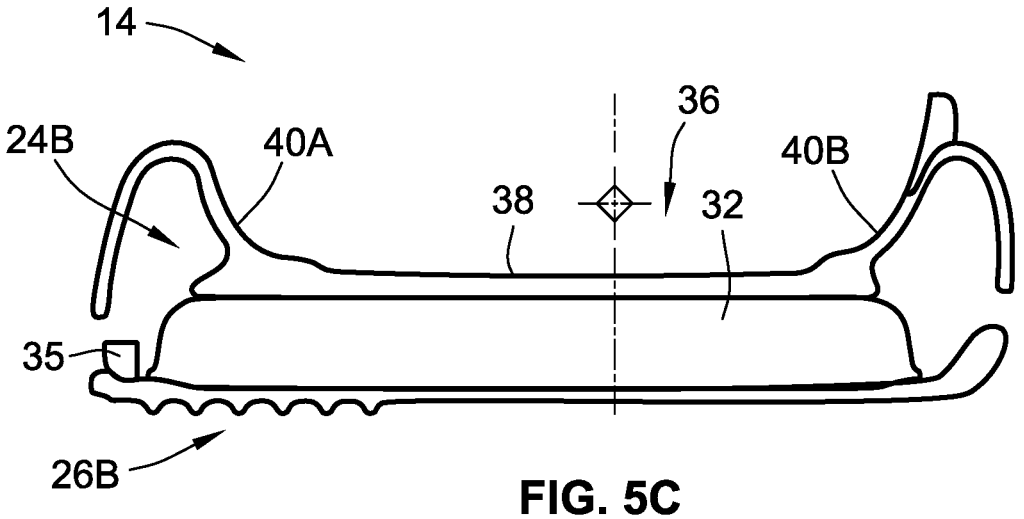
Figure 5D:
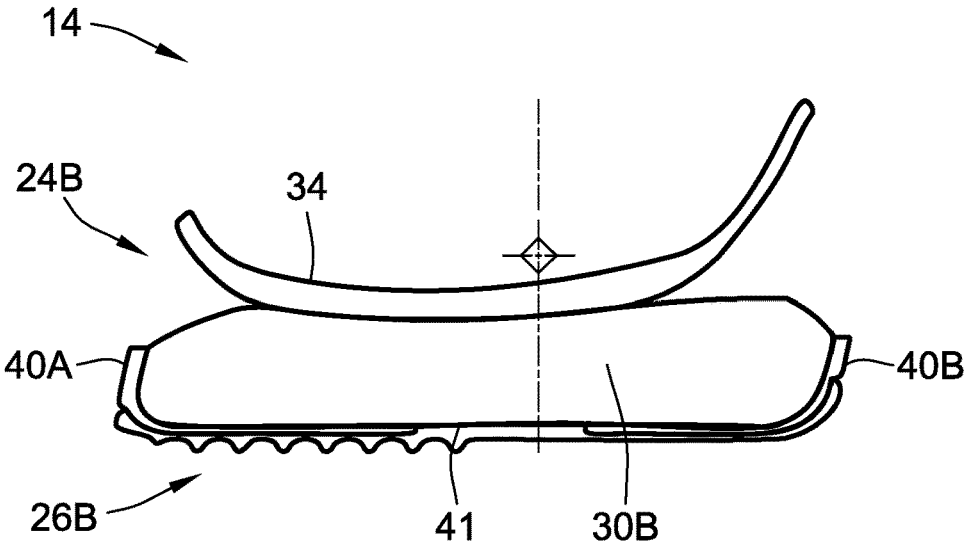
Figure 5E:
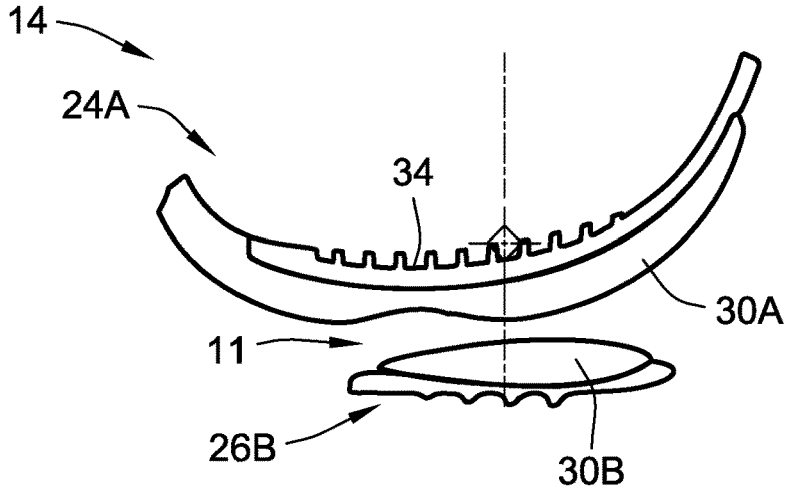
Figure 5F:
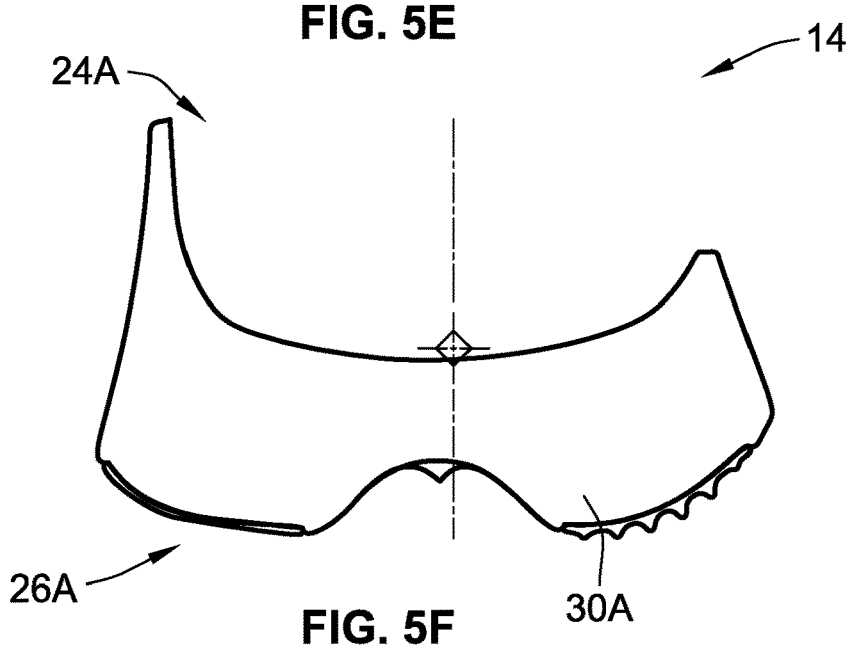

In accord with the illustrated example, the forefoot cage 36 may lack physical contact with the longitudinal and lateral faces of the forefoot bladder 32 to maintain an "open-faced" construction that allows the bladder 32 to expand and contract without impediment. With collective reference to FIGS. 4 and 5B-5D, the arcuate cage wings 40A, 40B project upward, rearward, and downward from the cage plate 38; the cage wings 40A, 40B wrap around, without physically contacting, the medial and lateral sides of the fluid-filled forefoot bladder 32. Proximal ends of the arcuate cage wings 40A, 40B (FIG. 5B) are integrally formed to or otherwise adjoined with the cage plate 38. FIG. 5B illustrates the cage wings 40A, 40B initially projecting outwards and upwards from the cage plate 36. The cage wings 40A, 40B then project further outwards and downwards with respect to the footwear 10, as best seen in FIG. 5C. Distal ends of the arcuate cage wings 40A, 40B (FIG. 5D) then insert underneath the rear forefoot cushion 30B such that the cage wings 40A, 40B are interposed between the forefoot cushion 30B and the forefoot outsole segment 26B.

To facilitate mediolateral flexion of the midsole 24 to help enhance lateral gait movement of the user, the distal ends of the arcuate cage wings 40A, 40B may be separated from each other via a raised outsole section 41 of the outsole segment 26B. To facilitate vertical expansion and contraction of the forefoot bladder 32, the distal ends of the arcuate cage wings 40A, 40B are spaced from, without touching, the fluid-filled bladder 32. The forefoot cage 36 may also function as a passive strut assembly that structurally reinforces the forefoot midsole segment 24B while damping impact forces during use of the footwear 10 and concomitantly biasing the forefoot outsole segment 26B away from the upper 12 in a manner similar to a vehicle suspension system. The forefoot cage 36 also protects that medial and lateral faces of the forefoot bladder 32 from debris and inadvertent puncturing. The cage wings 40A, 40B may also define outermost sidewalls of the footwear midsole 24.

Additional features may be reflected in the following clauses:

Clause 1: a sole structure for an article of footwear, the article of footwear having an upper with a forefoot region, a midfoot region, and a hindfoot region, the sole structure including: an outsole including an outsole upper surface and an outsole lower surface opposite the outsole upper surface and defining a ground-engaging surface of the footwear; a midsole including: a first midsole segment including a first cushion attached on one side thereof to the outsole upper surface and configured to attach on an opposite side thereof to the hindfoot region of the upper, and a second midsole segment spaced from the first midsole segment by a midfoot gap, the second midsole segment including a second cushion and a fluid-filled bladder spaced from the second cushion by a first forefoot gap, the second cushion and the fluid-filled bladder each attached on one side thereof to the outsole upper surface and each configured to attach on an opposite side thereof to the forefoot region of the upper; and a cage at least partially surrounding the second midsole segment, the cage including a cage plate configured to attach to the upper and located on a top surface of the fluid-filled bladder, and a plurality of arcuate cage wings projecting from opposing lateral sides of the cage plate and inserting between the second cushion and the outsole.

Clause 2: the sole structure of clause 1, wherein the arcuate cage wings wrap around, without touching, lateral sides of the fluid-filled bladder.

Clause 3: the sole structure of clause 1 or clause 2, wherein the arcuate cage wings each includes a proximal end integral with the cage plate and a distal end interposed between the second cushion and the outsole, the distal ends of the arcuate cage wings being separated from each other via a raised section of the outsole.

Clause 4: the sole structure of clause 3, wherein the distal ends of the arcuate cage wings are spaced from, without touching, the fluid-filled bladder.

Clause 5: the sole structure of any one of clauses 1 to 4, wherein the outsole includes: a first outsole segment including a first outsole upper surface mounted to the first midsole segment and not mounted to the second midsole segment; and a second outsole segment spaced from the first outsole segment by the midfoot gap and including a second outsole upper surface mounted to the second midsole segment.

Clause 6: the sole structure of clause 5, wherein the first outsole segment further includes a first outsole lower surface opposite the first outsole upper surface and defining a first segment of the ground-engaging surface of the footwear, and the second outsole segment further includes a second outsole lower surface opposite the second outsole upper surface and defining a second segment of the ground-engaging surface discrete from the first segment of the ground-engaging surface.

Clause 7: the sole structure of any one of clauses 1 to 6, wherein the second midsole segment further includes a third cushion spaced from the fluid-filled bladder by a second forefoot gap, the third cushion configured to attach on one side thereof to the forefoot region of the upper and attached on an opposite side thereof to the outsole upper surface.

Clause 8: the sole structure of clause 7, wherein the upper includes a strobel defining a bottom surface of the upper, and wherein the third cushion is configured to mount directly to the strobel.

Clause 9: the sole structure of clause 7 or clause 8, wherein the third cushion is located on a front side of the fluid-filled bladder and the second cushion is located on a rear side of the fluid-filled bladder such that the fluid-filled bladder is interposed between the second and third cushions.

Clause 10: the sole structure of any one of clauses 1 to 9, further comprising a moderator plate configured to mount to the forefoot, midfoot, and hindfoot regions of the upper, wherein the first and second cushions and the fluid-filled bladder are mounted directly to the moderator plate.

Clause 11: the sole structure of clause 10, wherein the cage and the moderator plate are integrally formed as a single-piece structure.

Clause 12: the sole structure of any one of clauses 1 to 11, wherein the first and second cushions are formed from a polymeric foam material, the outsole is formed from a synthetic rubber material, and the cage is formed from a thermoplastic elastomer.

Clause 13: the sole structure of any one of clauses 1 to 12, wherein the upper further includes a heel counter defining a rearward end of the upper, and wherein the first midsole segment is configured to wrap around and press against the heel counter to define a heel stabilizer.

Clause 14: the sole structure of any one of clauses 1 to 13, wherein the upper includes a strobel defining a bottom surface of the upper, and wherein the first cushion is configured to mount directly to the strobel.

Clause 15: the sole structure of any one of clauses 1 to 14, wherein the first cushion includes a first cushion ledge projecting from the hindfoot region into the midfoot region, and the second cushion includes a second cushion ledge projecting from the forefoot region into the midfoot region, the second cushion ledge located underneath and spaced from the first cushion ledge by the midfoot gap.

Clause 16: an article of footwear for a foot of a user, the footwear comprising: an upper configured to receive the foot of the user; and a sole structure attached to the upper and including: an outsole including an outsole upper surface and an outsole lower surface opposite the outsole upper surface and defining a ground-engaging surface of the footwear; a midsole including: a first midsole segment with a first cushion attached on one side thereof to the outsole upper surface and attached on an opposite side thereof to the hindfoot region, and a second midsole segment spaced from the first midsole segment by a midfoot gap, the second midsole segment including a second cushion, a third cushion and a fluid-filled bladder interposed between and spaced from the second and third cushions by first and second forefoot gaps, respectively, the second and third cushions and the fluid-filled bladder each attached on one side thereof to the outsole upper surface and each attached on an opposite side thereof to the forefoot region of the upper; and a cage at least partially surrounding the second midsole segment, the cage including a cage plate mounted to the upper and a top surface of the fluid-filled bladder, and a plurality of arcuate cage wings projecting from opposing lateral sides of the cage plate and inserting between the second cushion and the outsole.

Clause 17: the footwear of clause 16, including the elements and/or limitations of any one or more or all of clauses 2 to 15.

Clause 18: a method of manufacturing a sole structure for an article of footwear having a forefoot region, a midfoot region, and a hindfoot region, the method comprising: forming an outsole with an outsole upper surface and an outsole lower surface opposite the outsole upper surface and defining a ground-engaging surface of the footwear; forming a midsole including: a first midsole segment including a first cushion configured to attach to the hindfoot region of the upper, and a second midsole segment including a second cushion and a fluid-filled bladder each configured to attach to the forefoot region of the upper such that the second midsole segment is spaced from the first midsole segment by a midfoot gap; attaching the first cushion of the first midsole segment to the outsole upper surface; attaching the second cushion and the fluid-filled bladder to the outsole upper surface such that the fluid-filled bladder is spaced from the second cushion by a first forefoot gap; forming a cage configured to at least partially surround the second midsole segment, the cage including a cage plate and a plurality of arcuate cage wings projecting from opposing lateral sides of the cage plate, the cage plate configured to attach to the upper; attaching the cage plate to the fluid-filled bladder; and inserting the arcuate cage wings between the second cushion and the outsole.

Clause 19: the method of clause 18, further comprising wrapping the arcuate cage wings around, without touching, lateral sides of the fluid-filled bladder.

Clause 20: the method of clause 19, wherein the arcuate cage wings each includes a proximal end integral with the cage plate and a distal end interposed between the second cushion and the outsole, the distal ends of the arcuate cage wings being separated from each other via a raised section of the outsole.

Clause 21: the method of any one of clause 20, wherein the distal ends of the arcuate cage wings are spaced from, without touching, the fluid-filled bladder.

Clause 22: the method of any one of clauses 18 to 21, wherein the outsole includes: a first outsole segment including a first outsole upper surface mounted to the first midsole segment and not mounted to the second midsole segment; and a second outsole segment spaced from the first outsole segment by the midfoot gap and including a second outsole upper surface mounted to the second midsole segment.

Clause 23: the method of any one of clauses 18 to 22, wherein the second midsole segment further includes a third cushion configured to attach to the forefoot region of the upper, the method further comprising attaching the third cushion to the outsole upper surface such that the third cushion is spaced from the fluid-filled bladder by a second forefoot gap.

Clause 24: the method of clause 23, wherein the third cushion is located on a front side of the fluid-filled bladder and the second cushion is located on a rear side of the fluid-filled bladder such that the fluid-filled bladder is interposed between the second and third cushions.

Clause 25: the method of any one of clauses 18 to 24, further comprising: forming a moderator plate configured to mount to the forefoot, midfoot, and hindfoot regions of the upper; and mounting the first and second cushions and the fluid-filled bladder directly to the moderator plate.

Clause 26: the method of clause 18, wherein forming the cage and forming the moderator plate includes integrally forming the cage and the moderator plate as a single-piece structure.

Clause 27: the method of clause 18, including the elements and/or limitations of any one or more or all of clauses 2 to 15.

Aspects of the present disclosure have been described in detail with reference to the illustrated embodiments; those skilled in the art will recognize, however, that many modifications may be made thereto without departing from the scope of the present disclosure. The present disclosure is not limited to the precise construction and compositions disclosed herein; any and all modifications, changes, and variations apparent from the foregoing descriptions are within the scope of the disclosure as defined by the appended claims. Moreover, the present concepts expressly include any and all combinations and subcombinations of the preceding elements and features.

What is claimed:

1. A sole structure for an article of footwear having an upper, the sole structure comprising:

an outsole including an outsole upper surface and an outsole lower surface opposite the outsole upper surface, the outsole lower surface defining a ground-engaging surface;

a midsole including a first cushion, a second cushion, and a fluid-filled bladder interposed between the first and second cushions, the first and second cushions each attached on bottom sides thereof to the outsole upper surface and each configured to attach on top sides thereof to the upper, the fluid-filled bladder spaced from the first cushion by a first gap and spaced from the second cushion by a second gap, the fluid-filled bladder attached on a bottom side thereof to the outsole upper surface and configured to attach on a top side thereof to the upper; and a cage including a cage plate and multiple cage wings integrally formed with the cage plate as a single-piece structure, the cage plate mounted on top of and covering substantially all of a top surface of the fluid-filled bladder and configured to attach to the upper, and the cage wings projecting from opposing medial and lateral sides of the cage plate, wrapping around medial and lateral sides of the fluid-filled bladder, and inserting between the second cushion and the outsole upper surface.

2. The sole structure of claim 1, wherein the cage wings are arcuate and spaced from the medial and lateral sides of the fluid-filled bladder without contacting the fluid filled bladder such that an empty void is defined between the cage wings and the fluid-filled bladder.

3. The sole structure of claim 1, wherein the cage wings each includes a proximal end integral with the cage plate and a distal end interposed between the second cushion and the outsole, the distal ends of the cage wings being separated from each other via a raised section of the outsole.

4. The sole structure of claim 3, wherein the distal ends of the cage wings are spaced from the fluid-filled bladder without contacting the fluid filled bladder.

5. The sole structure of claim 1, wherein the outsole further includes:

a first outsole segment including a first outsole upper surface mounted to the midsole; and a second outsole segment spaced from the first outsole segment and including a second outsole upper surface mounted to the midsole.

6. The sole structure of claim 5, wherein the first outsole segment further includes a first outsole lower surface opposite the first outsole upper surface and defining a first segment of the ground-engaging surface, and the second outsole segment further includes a second outsole lower surface opposite the second outsole upper surface and defining a second segment, discrete from the first segment, of the ground-engaging surface.

7. The sole structure of claim 1, wherein the midsole further includes a third cushion spaced from the fluid-filled bladder by a third gap, the third cushion configured to attach on a top side thereof to the upper and attached on a bottom side thereof to the outsole upper surface.

8. The sole structure of claim 7, wherein the first and third cushions are configured to mount directly to a bottom surface of the upper.

9. The sole structure of claim 7, wherein the third cushion is spaced from the second cushion and the fluid-filled bladder with the second cushion interposed between the fluid-filled bladder and the third cushion.

10. The sole structure of claim 7, further comprising a moderator plate mounted onto the top sides of the second and third cushions and configured to interpose between the upper and the second and third cushions.

11. The sole structure of claim 10, wherein the moderator plate and the cage, including the cage plate and the cage wings, are integrally formed as the single-piece structure.

12. The sole structure of claim 1, wherein the first and second cushions are formed from a polymeric foam material, the outsole is formed from a synthetic rubber material, and the cage is formed from a thermoplastic elastomer.

13. The sole structure of claim 1, wherein the first cushion and the cage plate are configured to mount directly to a bottom surface of the upper.

14. An article of footwear for a foot of a user, the footwear comprising:

an upper configured to receive the foot of the user; and a sole structure attached to the upper, the sole structure including:

an outsole with an outsole upper surface and an outsole lower surface opposite the outsole upper surface, the outsole lower surface defining a ground-engaging surface of the footwear;

a midsole with a first cushion, a second cushion, and a fluid-filled bladder interposed between the first and second cushions, the first and second cushions each attached on bottom sides thereof to the outsole upper surface and each attached on top sides thereof to the upper, the fluid-filled bladder spaced from the first cushion by a first gap and spaced from the second cushion by a second gap, the fluid-filled bladder attached on a bottom side thereof to the outsole upper surface and attached on a top side thereof to the upper; and a cage with a cage plate and multiple cage wings integrally formed with the cage plate as a single-piece structure, the cage plate mounted directly to, extending across, and covering substantially all of a top surface of the fluid-filled bladder and mounted directly to a bottom surface of the upper, and the cage wings projecting from opposing medial and lateral sides of the cage plate, wrapping around medial and lateral sides of the fluid-filled bladder to define an empty void between the cage wings and the fluid-filled bladder, and inserting between the second cushion and the outsole upper surface.

15. A method of manufacturing a sole structure for an article of footwear, the method comprising:

forming an outsole with an outsole upper surface and an outsole lower surface opposite the outsole upper surface, the outsole lower surface defining a ground-engaging surface;

forming a midsole including a first cushion, a second cushion, and a fluid-filled bladder interposed between the first and second cushions, the first and second cushions each attached on bottom sides thereof to the outsole upper surface and each configured to attach on top sides thereof to an upper of the article of footwear, the fluid-filled bladder spaced from the first cushion by a first gap and spaced from the second cushion by a second gap, the fluid-filled bladder attached on a bottom side thereof to the outsole surface and configured to attach on a top side thereof to the upper;

attaching the first cushion to the outsole upper surface such that the first cushion is spaced from the fluid-filled bladder by a first gap;

attaching the second cushion and the fluid-filled bladder to the outsole upper surface such that the fluid-filled bladder is spaced from the second cushion by a second gap;

forming a cage with a cage plate and multiple cage wings as a single-piece structure, the cage wings projecting from opposing medial and lateral sides of the cage plate, and the cage plate configured to attach to a bottom surface of the upper;

attaching the cage plate to a top surface of the fluid-filled bladder such that the cage wings wrap around medial and lateral sides of the fluid-filled bladder and the cage plate covers substantially all of the top surface of the fluid-filled bladder; and inserting the cage wings between the second cushion and the outsole.

16. The method of claim 15, wherein the cage wings are arcuate and spaced from the medial and lateral sides of the fluid-filled bladder without contacting the fluid filled bladder to thereby define an empty void between the cage wings and the fluid-filled bladder.

17. The method of claim 16, wherein the cage wings each includes a proximal end integral with the cage plate and a distal end interposed between the second cushion and the outsole, the distal ends of the cage wings being separated from each other via a raised section of the outsole.

18. The method of claim 17, wherein the distal ends of the cage wings are spaced from the fluid-filled bladder without contacting the fluid filled bladder.

19. The method of claim 15, wherein the outsole includes:

a first outsole segment including a first outsole upper surface mounted to the midsole; and a second outsole segment spaced from the first outsole segment and including a second outsole upper surface mounted to the midsole.

20. The method of claim 15, wherein the midsole further includes a third cushion, the method further comprising attaching the third cushion to the outsole upper surface such that the third cushion is spaced from the fluid-filled bladder by a third gap.

21. The method of claim 20, wherein the third cushion is spaced from the second cushion and the fluid-filled bladder with the second cushion interposed between the fluid-filled bladder and the third cushion.

22. The method of claim 15, further comprising:

forming a moderator plate configured to mount to the upper; and mounting the first and second cushions to the moderator plate.

23. The method of claim 22, wherein forming the cage and forming the moderator plate includes integrally forming the cage and the moderator plate as a single-piece structure.

* * * * *